United States Patent [19]

Lazarus

[11] Patent Number: 4,568,027

[45] Date of Patent: Feb. 4, 1986

[54] FLUID SPRAY-FORMING DEVICE

[75] Inventor: Richard Lazarus, Brewster, Mass.

[73] Assignee: Hydralast Products, Inc., Mansfield, Mass.

[21] Appl. No.: 494,259

[22] Filed: May 13, 1983

[51] Int. Cl.[4] ..... B05B 1/14

[52] U.S. Cl. ..... 239/590.3; 239/569

[58] Field of Search ..... 239/499, 590.3, 569, 239/578, 579, 102, 587, 590

[56] References Cited

U.S. PATENT DOCUMENTS

| | | | |
|---|---|---|---|
| 2,285,831 | 6/1942 | Pennypacker | 299/144 |
| 2,475,919 | 5/1946 | Shook | 299/141 |
| 2,776,168 | 1/1957 | Schweda | 239/587 |
| 2,974,877 | 3/1961 | Hruby, Jr. | 239/237 |
| 2,985,385 | 5/1961 | Bowers et al. | 239/499 X |
| 3,047,239 | 7/1962 | Canavan | 239/579 |
| 3,358,934 | 12/1967 | Moen | 239/443 |
| 3,762,648 | 10/1973 | Deines et al. | 239/102 X |
| 3,831,860 | 8/1974 | Gullaksen | 239/500 |
| 4,013,230 | 3/1977 | Gondek | 239/499 |
| 4,055,306 | 10/1977 | Hruby, Jr. | 239/102 X |
| 4,221,336 | 9/1980 | Diamond | 239/428 |
| 4,272,022 | 6/1981 | Evans | 239/107 |
| 4,273,289 | 6/1981 | Jette | 239/458 |
| 4,360,160 | 11/1982 | Jette | 239/579 X |
| 4,426,040 | 1/1984 | Smith | 239/590.3 X |

FOREIGN PATENT DOCUMENTS

| | | |
|---|---|---|
| 353605 | 10/1937 | Italy . |
| 192084 | 1/1923 | United Kingdom . |

*Primary Examiner*—Jeffrey V. Nase
*Assistant Examiner*—Daniel R. Edelbrock
*Attorney, Agent, or Firm*—Lahive & Cockfield

[57] ABSTRACT

Disclosed is an improved fluid spray-forming device or showerhead which is energy efficient and produces a high fluid velocity and a forceful spray. The device has a relatively large, substantially cylindrical chamber between a restricted input flow path and a spray-forming disk. This combination changes the fluid flow properties to achieve the improved results. A pulsating spray can be obtained by proper selection of the ratios of the input, chamber and output diameters, thus making a mechanical fluid interrupter unnecessary.

3 Claims, 6 Drawing Figures

FLUID SPRAY-FORMING DEVICE

BACKGROUND OF THE INVENTION

The present invention relates to a device for forming a fluid spray. More particularly, the invention relates to an improved fluid spray-forming device or showerhead which is inexpensive to manufacture and highly energy efficient. The improved device produces a spray output which is very forceful and has a high fluid velocity compared to the spray normally obtained from conventional energy savings showerheads. The invention also includes a new type of pulsating showerhead.

There are three general types of showerheads presently available: standard showerheads, pulsating showerheads, and energy savings, aerating showerheads. The term showerhead as used herein designates any device which attaches to a fluid supply through an inlet tube and creates a spray by changing the fluid pattern to form discrete particles or droplets.

The standard showerhead has a flow path connecting the fluid inlet tube to a spray-forming disk, the flow path having substantially the same diameter as the fluid inlet tube. The disk has a plurality of hole or exit passages to produce a spray which may be further shaped by an output nozzle. The spray from the standard showerhead, assuming there is sufficient water pressure, is powerful. While this standard showerhead is inexpensive to construct, it is energy inefficient because it uses a large volume of water to form the shower.

The pulsating showerhead, such as that sold under the tradename "Water Pik", is a fairly recent innovation and has achieved considerable popularity. The pulsating showerheads employ a mechanical device between the input and the spray-forming disk to interrupt the fluid flow at periodic intervals and form the pulsation. The fluid pulse has a higher velocity than the standard showerhead velocity so, despite the fact that the horizontal component is not great, the pulsating showerheads use a lot of water. These pulsating showerheads are expensive to manufacture and they are prone to mechanical breakdown.

Energy saving, aerating showerheads, which first achieved popularity following the increase in oil costs in the 1970s, save energy by reducing the water flow. These showeheads have a flow path substantially smaller than the fluid inlet tube but use a conventional output disk. The highly turbulent water flow caused by the small flow path opening at the disk yields a highly aerated water-efficient shower. Some energy saving showerheads even have means to cut off or reduce the water flow so no water is wasted while soaping. The major difficulty with these conventional energy saving showerheads is that the spray is relatively weak.

Other spray-forming devices such as sprinklers or hose nozzles use similar means to form the spray. These devices are relatively energy and fluid inefficient.

Accordingly, it is an object of the invention to provide a spray-forming device which is energy efficient while yielding better spray characteristics than currently available devices. Another object of the invention is to provide a relatively inexpensive, energy efficient showerhead which yields a forceful spray. A further object of the invention is to provide a relatively inexpensive pulsating showerhead which is not subject to mechanical breakdown. These and other objects and features of the invention will be apparent from the following description and from the drawing.

SUMMARY OF THE INVENTION

The present invention features a device for producing a fluid spray in an energy efficient manner. The device has a base member attached to a fluid supply and which includes an inlet port connected to an outlet port by a flow path. The device has a substantially cylindrical chamber having an inlet aperture and an exit aperture; the inlet aperture is in fluid communication with the outlet port and the exit aperture is in fluid communication with spray-forming apparatus. The diameter of the chamber is substantially larger than the diameter of the input aperture, while the length of the chamber between the apertures is at least as great as the chamber diameter, and preferably is one to four times the chamber diameter. The spray-forming apparatus consists of a bulkhead or disk having a plurality of exit passages therethrough. Preferably, the ratio of the cross-sectional area of the input aperture to the total cross-sectional area of the plurality of exit passages is between 0.7 and 4, while the ratio of the diameter of the input aperture to the diameter of the chamber is preferably between 0.05 and 0.5. The base member may include a mounting ring for attaching the device to the fluid supply, and a pivoting device or ball-joint. The ball-joint has a fluid path connecting the fluid supply to the outlet port and may include an elongate neck section coupling the inlet aperture and the outlet port. The mounting ring has mounted therein a resilient gasket for sealing the device to the fluid supply and may have at least one notch about its periphery. The resilient gasket is also adapted for substantially covering the input port (thereby shutting off the fluid supply) when the elongate neck engages a notch.

The invention also features a showerhead which is attached to a shower inlet tube or fluid supply by a mounting ring having notches about its periphery. A resilient gasket mounted within the mounting ring seals the showerhead to the shower inlet tube. A ball-joint having an input port, an outlet port and a flow path therebetween is pivotally mounted in the mounting ring. The showerhead has a substantially cylindrical flow chamber with an inlet aperture and an exit aperture in fluid communication with the fluid supply. The length of the flow chamber between the apertures is 1 to 4 times the chamber diameter while the chamber diameter is 2 to 20 times the diameter of the inlet aperture. The showerhead also includes a connector coupling the outlet port to the inlet aperture, the coupler adapted to engage any of the notches on the mounting ring thereby causing the resilient gasket to cover the inlet port and shut off the fluid supply. A bulkhead-forming element which includes a plurality of exit passages substantially encloses the exit aperture, and the showerhead also includes a venturi nozzle in fluid communication with the bulkhead. The ratio of the cross-sectional area of the inlet aperture to the total cross-sectional area of the exit passages at the bulkhead ranges from 0.7 to 4. The venturi nozzle has a recessed ring about its edge to promote fluid spray substantially free of weeping.

The invention further features a showerhead which produces a pulsating spray. This showerhead includes a coupling element for attaching a showerhead to a fluid supply, a substantially cylindrical chamber, a spray-forming device and a pulsation-forming apparatus. The length of the chamber between its inlet and its outlet is 0.5 to 3 times its diameter. Preferably, the spray-forming device is a bulkhead having a plurality of exit passages. In one embodiment, the pulsation-forming apparatus is a bezelled input aperture opening at the chamber. The diameter of the bezelled apparatus is substantially equal to the diameter of the chamber at the opening. In another embodiment, the length of the chamber is 1 to 3 times its diameter and the pulsation-forming apparatus is a device which decreases the diameter of the input, causing a lower input/chamber diameter ratio.

DESCRIPTION OF ILLUSTRATED EMBODIMENT

A brief description of fluid flow properties is helpful in order to understand the present invention. In fluid dynamics, the Reynolds number is used to distinguish between laminar flow fluids and turbulent flow fluids. In laminar flow, the Reynolds number is low and the fluid flows in substantially straight paths. As the Reynolds number increases, turbulent flow commences with accompanying boundary eddies. In the present invention, the addition of the cylindrical chamber before the exit disk appears to change the flow properties of the fluid to form a selectively mixed laminar-turbulent flow system. It is unclear why this mixed system occurs, but the result appears to be a higher velocity fluid flow under the same input fluid pressure than is achieved with conventional energy saving showerheads. One hypothesis for the enhanced velocity is that the eddy effects of the mixed flow substantially interrupt the flow, thereby causing pulsations in the fluid output. Generally, the time constant (T) of the pulsations is such that the spray appears to be conventional but the velocity is higher. By varying the size of the chamber of the input/chamber size ratios, the eddy effects are modified and this modification varies the time constant T. By proper selection of the chamber size or by changing the effective size of the chamber, an easily observable pulsation in the fluid flow is produced. It appears that the improved flow properties only occur with a mixed flow. If the chamber is too short, the turbulence is so great that no laminar flow is found while if the chamber is too long, the laminar flow dominates.

Figure 1:
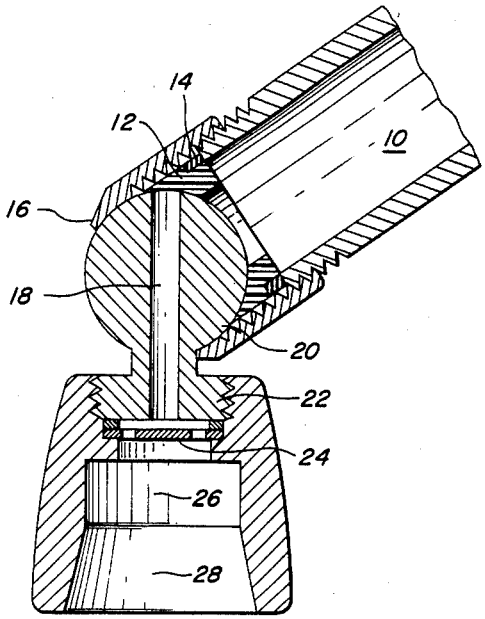
FIG. 1 is a cross-sectional drawing of a conventional energy saving showerhead.

FIG. 1 illustrates a conventional energy saving, aerating showerhead. The showerhead has been modified using a notched mounting ring to allow easy disruption of the fluid flow. The showerhead is attached to a shower inlet tube 10 by mounting ring 12. Resilient gasket 14 seals the showerhead to shower inlet tube 10, minimizing leaks. The fluid entering from shower inlet tube 10 passes through inlet port 16 into flow passage 18 of ball-joint 20. Fluid exits flow passage 18 through outlet port 22 and strikes disk 24 setting up a highly turbulent flow pattern at disk 24. Disk 24 includes exit passages 26 which form the fluid flow into a spray which is partially shaped by venturi nozzle 28. Tests conducted using this type of showerhead (sold commercially as Hydrolast Jet Stream Model HS-1) show that a relatively wide, highly aerated spray is produced.

Figure 2:
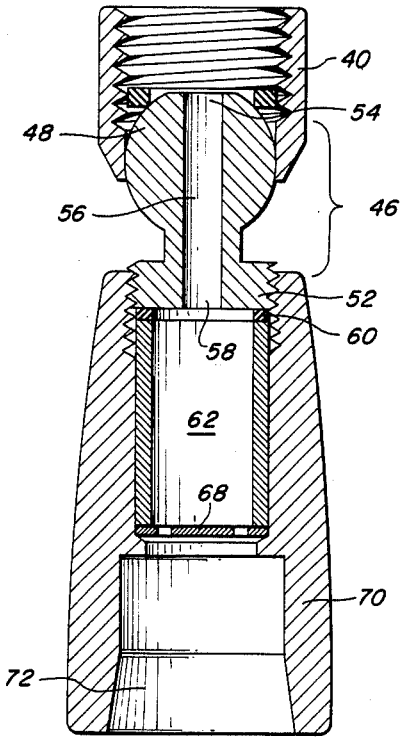
FIG. 2 is a cross-sectional drawing of a showerhead of the invention.
Figure 3:
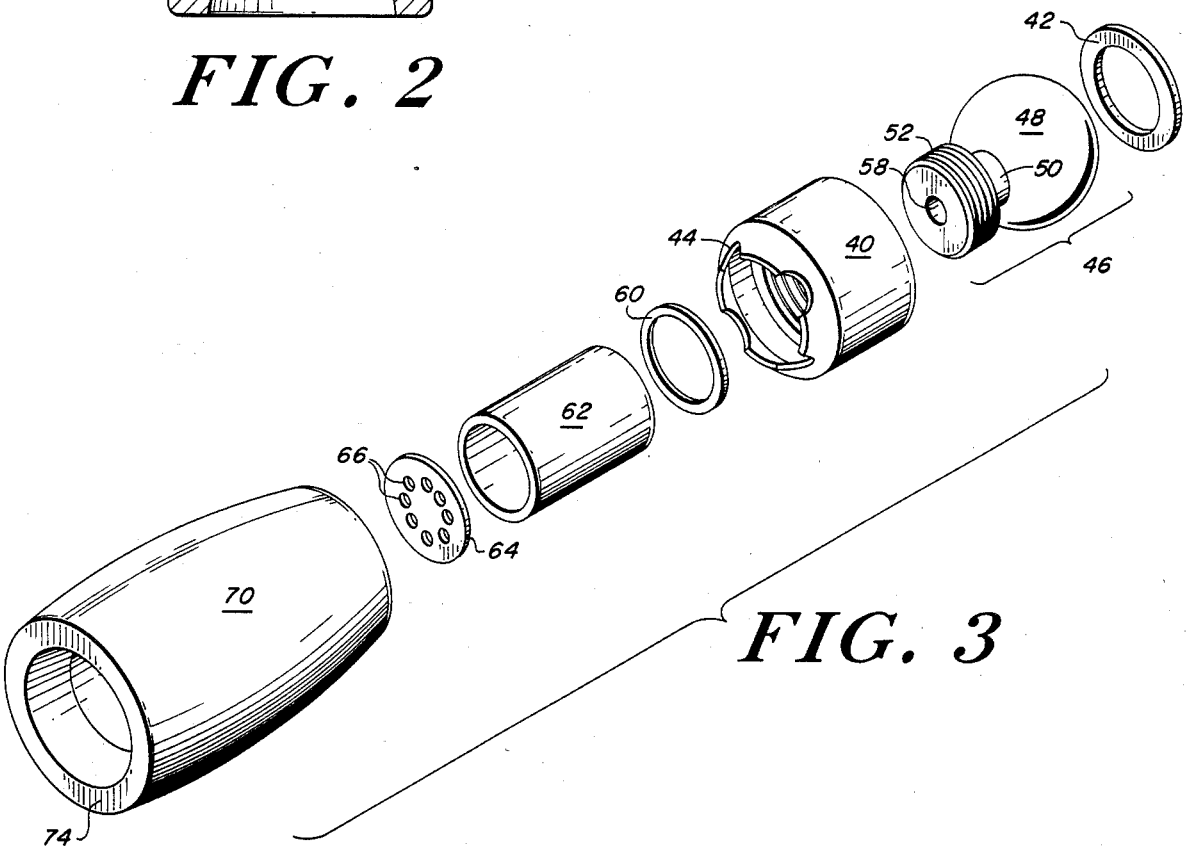
FIG. 3 is an exploded view of the showerhead of FIG. 2.

The present invention uses a substantially cylindrical chamber to modify the flow pattern of the fluid before it reaches the exit passages of the disk. FIG. 2 illustrates a cross-sectional view of a showerhead of the present invention while FIG. 3 illustrates the same showerhead in an exploded view. The showerhead is attached to a threaded shower input tube (not illustrated) by a mounting ring 40. A resilient gasket 42 is mounted within mounting ring 40 and seals the showerhead to the shower inlet tube. Mounting ring 40 also includes a series of notches 44 about its periphery. A ball-adaptor 46 comprising a ball-joint section 48, an elongate neck 50, and a threaded section 52 is mounted within mounting ring 40. While ball-adaptor 46 is illustrated as a single unit, elongate neck 50 or threaded section 52 could be separate units. Fluid enters ball-adaptor 46 through input port 54, passes through flow passage 56 and exits at inlet aperture 58. In the illustrated embodiment, there is no separate outlet port but rather the outlet port is part of flow passage 56. A second gasket 60 separates and seals ball-adaptor 46 to cylindrical chamber 62. A spray-forming disk or bulkhead 64 containing many exit passages 66 (ten are illustrated) encloses exit aperture 68 of cylindrical chamber 62. Venturi nozzle 70 encircles chamber 62 and includes a bevelled portion 72 which assists in shaping the spray formed by the showerhead. Venturi nozzle 70 also includes a recessed ring 74 at its end to prevent weeping about the edge of the nozzle.

The following non-limiting examples, which use showerheads similar to those illustrated in FIGS. 1–3, assist illustrating the practice of the present invention.

EXAMPLE 1

Example 1 illustrates that varying the dimensions of the flow chamber can change the output pattern of the shower. The five showerheads listed in Table 1 were fabricated to illustrate this effect. Showerhead 1 does not have a flow chamber, Showerhead 2 has a wide narrow chamber, Showerhead 3 and 4 have moderate sized chambers, and Showerhead 5 has a long, narrow chamber. All of the showerheads listed in Table 1 had inlet apertures with a cross-sectional area of 0.0176 in.$^2$ and the total cross-sectional area of the exit passages was 0.0170 in.$^2$.

TABLE 1

| Shower-head | Chamber Diameter (in.) | Chamber Length (in.) | L/D Ratio |
|---|---|---|---|
| 1 | 0.0 | 0.0 | — |
| 2 | 0.7 | 0.44 | 0.629 |
| 3 | 0.5 | 0.9375 | 1.86 |
| 4 | 0.7 | 0.969 | 1.38 |
| 5 | 0.5 | 1.84 | 3.61 |

Tests were conducted using plexiglass showerheads to observe differences in the flow pattern in the chambers. All of the observed differences of the spray properties are qualitative and all the testing was conducted using a constant water pressure.

Showerhead 1 illustrates the conventional energy saving showerhead as shown in FIG. 1. This showerhead produced the wide, highly aerated, relatively weak spray commonly associated with conventional energy saving showerheads. The large horizontal component of the spray is believed to be caused by the extreme turbulence at the disk.

Showerhead 2 had a short wide plenum with a length to diameter (L/D) ratio of 0.629. The flow pattern in the chamber was highly turbulent and the shower, while less atomized than that produced by Showerhead 1, was still misty and weak. This showerhead and Showerhead 1 are outside the scope of the present invention.

While Showerhead 2 showed a highly turbulent flow pattern in the chamber, Showerhead 3 illustrated a mixed laminar-turbulent flow. This showerhead had an L/D ratio of 1.86 and formed a spray which was much stronger than that of Showerheads 1 or 2. In fact, a pulsating spray pattern was observed from this showerhead. Showerhead 3, which is within the scope of the invention, formed an acceptable spray.

Showerhead 4 had a wider chamber (L/D ratio of 1.38) than Showerhead 3. The observed flow pattern in the chamber was interrupted laminar; that is, laminar flow would appear in the chamber and then disappear into the turbulent pattern. The spray pattern from this showerhead was more atomized, e.g., aerated, than the spray of Showerhead 3, but it was still good. Pulsations in the spray pattern were barely detectable.

Showerhead 5 had a long, narrow (L/D ratio of 3.61) chamber but was still within the scope of the present invention. While some turbulent effect was still seen at the disk, the flow pattern throughout the chamber was mainly laminar. The spray from the showerhead had very little aeration; that is, a penetrating, needle-like spray was produced and no pulsations were observed. This shower was also acceptable, if actually too hard. Showerheads 4 and 5 are within the scope of the invention.

In light of these results, it is clear that varying the dimensions of the chamber can effect the quality of the spray.

EXAMPLE 2

Example 2 illustrates another means of changing the flow pattern, namely by adjusting the input aperture to exit passage area ratio.

A series of showerheads were constructed having a chamber diameter of 0.5 inches and a chamber length between input and exit aperatures of 0.9375 inches, yielding an L/D ratio of 1.875. Tests were conducted by varying the cross-sectional area of the input aperture. A standard disk having ten exit passages with a total cross-sectional area of 0.017 in.$^2$ was used throughout.

An interesting effect was observed when the ratio of the input area to output area was 0.5 or below. At this ratio, not only was the spray unacceptable because the flow was too narrow, a node was formed several inches below the showerhead.

By raising the ratio of the input area to the exit area to 0.7, a narrow, barely acceptable shower pattern was observed. At a 0.8 ratio, an acceptable atomized spray was formed while at a 1.0 ratio, an excellent wide spray pattern was formed. As the ratio increased above 1, the spray pattern began to narrow again. At a 1.75 ratio, a narrow, pulsating spray was formed while at a 3.0 ratio, the flow from the showerhead was substantially laminar.

It appears that at very low input/output ratios (below 0.7) the chamber acts merely as an extension of the nozzle and the bevel of the nozzle becomes relatively unimportant. At ratios above 2.0, the turbulence of the flow appears to be compressed at the disk, and the laminar flow down the sides of the chamber shapes the spray.

Figure 4:
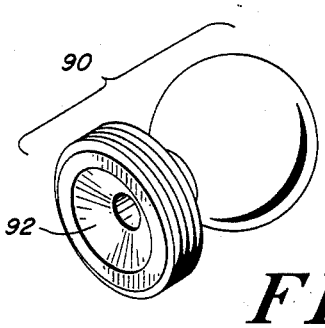
FIG. 4 is a cross-sectional drawing of an adaptor for a pulsating showerhead of the invention.

As is seen from Examples 1 and 2, a pulsating shower can be obtained in accord with practice of the invention by proper selection of chamber and aperture ratios. FIG. 4 illustrates that another means of forming a pulsating spray is to use a bezelled adaptor which modifies the input aperture. Adaptor 90 can replace ball-joint 46 of FIGS. 2 and 3. The use of adaptor 90 causes pulsations in the spray pattern even if the dimensions of chamber 62 and inlet aperture 58 would not otherwise cause pulsations. In fact, if Showerhead 2 of Example 1 is used with adapter 90, an acceptable, pulsating spray is formed. However, if the L/D ratio of the chamber is greater than 3, the use of adapter 90 adversely affects the spray characteristics of the system. It appears that bezelled adapter 90 acts as an extension of the chamber so smaller chambers can be used. While FIG. 4 illustrates adapter 90 as having a smooth bezelled portion 92, any irregularity in bezelled portion 92 appears to improve the pulsation characteristics of the spray. It is hypothesized that this irregularity may change the flow pattern to cause large eddy effects and more pulsation.

Figure 5:
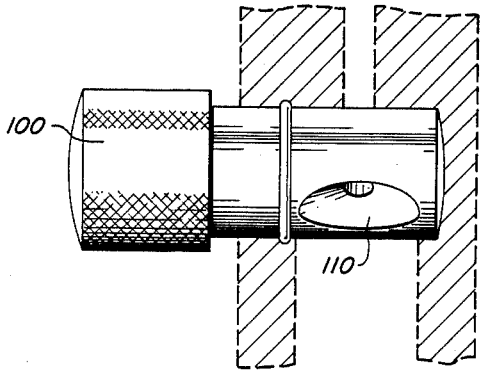
FIG. 5 is a full view of the bezelled portion of an adapter for changing the chamber input diameter, with the fluid spray forming device shown in phantom.
Figure 6:
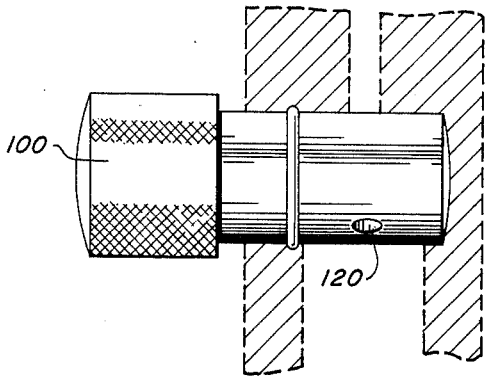
FIG. 6 is a full view of the straight portion of the adapter of FIG. 5, again with the spray forming device shown in phantom.

As previously discussed in connection with Example 2, a change in the dimensions of the input aperture can cause a pulsating spray pattern. Therefore, a mechanical device such as a throttle valve or slide plate having different size holes can be used to vary the input aperture size thereby changing a shower from a conventional to pulsating mode. As shown in FIGS. 5 and 6, it also is possible to construct a device which allows the section of the adapter nearest the chamber to vary from a bezelled to a straight shape. One example is a rotating rod having a flow path with a bezelled portion and a straight portion. By rotating the rod, a conventional spray can be modified to a pulsating spray. FIGS. 5 and 6 illustrate an adapter having a rotating rod 100 with a bezelled portion 110 and straight portion 120 defining the flow path. Turning rod 100 varies the diameter of the chamber input.

Those skilled in the art develop other obvious embodiments or variations of the present invention. Such embodiments and variations are within the scope of the following claims.

What is claimed is:

1. A showerhead for producing a pulsing spray comprising:

means for attaching said showerhead to a fluid supply;

a substantially cylindrical chamber in fluid communication with said fluid supply, said chamber having an inlet and an outlet, the length of said chamber between said inlet and said outlet being between 0.5 and 3 times its diameter;

pulsation-forming means in fluid communication with said chamber at said inlet, the pulsation-forming means comprising a bezelled input aperture opening at said chamber, the diameter of said input aperture substantially equal to the diameter of said chamber at said opening; and spray-forming means in fluid communication with said chamber at said outlet, the spray-forming means comprising a bulkhead having a plurality of exit passages therethrough.

2. The showerhead of claim 1 wherein the ratio of the length of said chamber to the diameter of said chamber is between 1 and 3.

3. The showerhead of claim 1 wherein said pulsation-forming means comprises means for varying the diameter of the chamber input.

* * * * *